US006548459B2

(12) United States Patent
Mondal et al.

(10) Patent No.: US 6,548,459 B2
(45) Date of Patent: Apr. 15, 2003

(54) PROCESS FOR PREPARING RUST INHIBITORS FROM CASHEW NUT SHELL LIQUID

(75) Inventors: Pankaj Kumar Mondal, Faridabad (IN); Khem Chand Dohhen, Faridabad (IN); Rakesh Sarin, Faridabad (IN); Deepak Kumar Tuli, Faridabad (IN); Niranjan Raghunath Raje, New Delhi (IN); Akhilesh Kumar Bhatnagar, Faridabad (IN)

(73) Assignee: Indian Oil Corporation Limited, Maharashtra (IN)

( * ) Notice: Subject to any disclaimer, the term of this patent is extended or adjusted under 35 U.S.C. 154(b) by 0 days.

(21) Appl. No.: 10/113,285

(22) Filed: Apr. 2, 2002

(65) Prior Publication Data

US 2003/0050198 A1 Mar. 13, 2003

(30) Foreign Application Priority Data

Sep. 3, 2001 (IN) ..... 846/MUM/2001

(51) Int. Cl.[7] ..... C10M 129/00; C10M 129/26

(52) U.S. Cl. ..... 508/457; 508/458; 252/396; 560/184; 560/188

(58) Field of Search ..... 508/458, 457; 252/396; 560/184, 188

(56) References Cited

U.S. PATENT DOCUMENTS

| | | | | |
|---|---|---|---|---|
| 3,909,215 | A | 9/1975 | Kray | |
| 4,247,414 | A | 1/1981 | Kimura et al. | |
| 4,395,498 | A | 7/1983 | Benham | |
| 4,427,565 | A | 1/1984 | Fields et al. | |
| 4,493,776 | A | 1/1985 | Rhodes | |
| 5,055,230 | A | 10/1991 | Clubley et al. | |
| 5,218,038 | A | 6/1993 | Johnson et al. | |
| 5,358,650 | A | 10/1994 | Srinivasan et al. | |
| 5,433,774 | A | 7/1995 | Kapl et al. | |
| 5,487,846 | A | 1/1996 | Otomo | |
| 5,910,468 | A | 6/1999 | Dohhen et al. | |
| 5,916,850 | A | 6/1999 | Tuli et al. | |
| 5,958,850 | A | 9/1999 | Matsuzaki et al. | |
| 6,165,952 | A | 12/2000 | Abramshe et al. | |
| 6,180,575 | B1 | 1/2001 | Nipe | |
| 6,339,052 | B1 * | 1/2002 | Dohhen et al. | 508/436 |

* cited by examiner

*Primary Examiner*—Jacqueline V. Howard
(74) *Attorney, Agent, or Firm*—Sidley Austin Brown & Wood LLP

(57) ABSTRACT

A process for the preparation of CNSL phenoxy carboxylic acid derivatives for use as an additive in a lubricant composition so as to impart improved rust inhibiting properties, including the steps of (a) partially hydrogenating distilled technical cashew nut shell liquid with palladium or nickel or platinum catalyst; to hydrogenate the olefinic chain; (b) reacting cashew nut shell liquid or partially hydrogenated technical cashew nut shell liquid with halogeno carboxylic acid derivatives to obtain unpolymerized cashew nut shell liquid phenoxy carboxylic acid derivatives, the reaction being carried out at a temperature ranging from 20 to 140° C. A lubricant containing a major proportion of a material selected from the group consisting of an oil of lubricating viscosity and a grease; and remainder an additive including CNSL phenoxy carboxylic acid derivative prepared by the foregoing process.

17 Claims, No Drawings

PROCESS FOR PREPARING RUST INHIBITORS FROM CASHEW NUT SHELL LIQUID

This application claims priority from and incorporates by reference Indian Patent Application No. 846/Mum/2001, filed Sep. 3, 2001.

BACKGROUND

Cashew nut shell liquid (CNSL) occurs as a reddish brown viscous liquid in the soft honeycomb structure of the shell of cashewnut, a plantation product obtained from the cashew tree, Anacardium Occidentale L. Native to Brazil, the tree grows in the coastal areas of Asia & Africa. Cashewnut attached to cashew apple is grey colored, kidney shaped and 2.5–4 cm long. The shell is about 0.3 cm thick, having a soft leathery outer skin and a thin hard inner skin. Between these skins is the honeycomb structure containing the phenolic material popularly called CNSL. Inside the shell is the kernel wrapped in a thin brown skin, known as the testa.

The nut thus consists of the kernel (20–25%), the shell liquid (20–25%) and the testa (2%), the rest being the shell. CNSL, extracted with low boiling petroleum ether, contains about 90% anacardic acid and about 10% cardol. CNSL, on distillation, gives the pale yellow phenolic derivatives, which are a mixture of biodegradable unsaturated m-alkylphenols, including cardanol. Catalytic hydrogenation of these phenols gives a white waxy material, predominantly rich in tetrahydroanacardol.

CNSL and its derivatives have been known for producing high temperature phenolic resins and friction elements, as exemplified in U.S. Pat. Nos. 4,395,498 and 5,218,038. Friction lining production from CNSL is also reported in U.S. Pat. No. 5,433,774. Likewise, it is also known to form different types of friction materials, mainly for use in brake lining system of automobiles and coating resins from CNSL. However, the first application of CNSL in making lubricating oil additives was disclosed by us in U.S. Pat. Nos. 5,916,850 and 5,910,468.

The general term to describe the moisture corrosion is rusting. Rusting is caused by electrochemical attack of oxygen through water on the ferrous metal surfaces of the gear. The rusting is greatly aggravated by the presence of sulphur and phosphorus compounds (EP & AW additives) and their thermal, oxidation or hydrolytic decomposition by-products. A good automotive or industrial gear oil should have ample rust preventive characteristics built-in to combat all eventualities.

Rust is the common oxidative corrosion on iron and its alloys and is the result of an electrochemical reaction. A great deal of research to develop means of controlling or eliminating rust has been conducted. Strategies to control the rust include eliminating oxygen or preventing the electrolyte and oxygen from interacting at the metal surface, the conditions not practically possible, or by the use of polar compounds known as rust inhibitors.

Rust inhibitors are generally surface active agents consisting of polar compounds. The structure of these polar compounds consists of a "head" which has a strong affinity for the metal surface and a hydrocarbon "tail" which orients itself away from the surface. These molecules form a tightly adsorbed monolayer, which prevents moisture and oxygen from reaching the metal surface. Common Chemistries of the polar head of these molecules include—Carboxylic acids, their esters, sulphonates, imidazolines, amines etc., performance of each class of the rust inhibitor depends upon:

Type of the other additives present in the system

Service conditions

Metallurgy type to be protected

An exhaustive literature review was conducted to examine the types of Chemistries in use for selection of the rust inhibitors for use in blending modern grades of gear lubricants. There was hardly any published literature correlating the performance of a RI with its Chemistry. However, there are a sizable number of patent references for development of rust inhibiting additives for gear oil applications. These include U.S. Pat. No. 6,180,575 (Jan, 2001. Mobil) for mixture of substituted benzotriazole and amine phosphates, U.S. Pat. No. 6,165,952 (Dec, 2000. Kings Industries) for mixture of condensed polyacids and amines, U.S. Pat. No. 5,358,650 (Oct, 1994. Ethyl) mixtures of aminosuccinic esters and dimer acids, U.S. Pat. No. 4,247,414 (Jan, 1981, Nippon), mixtures of alkylphenoxy ethyleneglycol and phosphate esters. Other patents which describe corrosion inhibiting compositions of gear oils include U.S. Pat. No. 5,055,230 (Oct, 1991, Ciba-Geigy), U.S. Pat. No. 4,493,776 (Jan, 1985, Shell) U.S. Pat. No. 4,427,565 (Jan, 1984, Standard Oil), U.S. Pat. No. 5,487,846 (Jan, 1996, Union Chemicals) and U.S. Pat. No. 3,909,215 (Sept, 1975, Chevron).

Literature review revealed that a large number of additives with different chemistries have been developed and used in gear oil compositions. Also, it has become increasingly evident that for passing CRC L-33 corrosion test, a combination of additives had to be used. This makes sense as L-33 rig contains parts having different metallurgies, i.e., cover plates, pinion and gears and the effective RI should be able to protect all these parts which count in the corrosion rating.

The present invention relates to lubricant compositions and more particularly, to lubricant compositions comprising oils of lubricating viscosity or greases thereof containing a minor rust inhibiting additive of alkyl phenoxy carboxylic acids and their esters or amides derived from cashew nut shell liquid.

Recently, our U.S. Pat. No. 5,916,850 described development of multifunctional additives from cashew nut shell liquid or from saturated alkylphenols derived from cashew nut shell liquid. The patent relates to a process for preparing di(alkylaryl)phosphorodithioate. The products of this invention were found to have better antifriction, extreme pressure and antiwear properties. In another U.S. Pat. No. 5,910,468, cashew nut shell liquid has been exploited for developing overbased calcium phenate detergents as additives for lubricant formulations.

The object of the present invention is to provide for a rust inhibiting alkyl phenoxy acetic acid/ester based lubricant/fuel additive, derived from CNSL, a renewable and biodegradable product from vegetable sources and often available at very low price, which would amount to substantial overall reduction in the cost of quality, energy efficient lubricant/fuel formulations.

Another object of the present invention is to provide for a lubricant composition and more particularly, to lubricant compositions comprising oils of lubricating viscosity or greases thereof containing a minor rust inhibiting additive derived from alkyl phenoxy acetic acid/ester derived from cashew nut shell liquid.

DETAILED DESCRIPTION OF THE INVENTION

To achieve the said objects, the present invention provides a process for the preparation of alkyl phenoxy carboxylic acid/ester for use as an additive in a lubricant composition by reacting said cashew nut shell liquid with halo carboxylic acid or ethyl chloroacetate to obtain corresponding unpolymerized cashew nut shell liquid alkyl phenoxy carboxylic acid/ester, the reaction being carried out at a temperature ranging from 20 to 140° C. Alternatively, rust inhibitor can be synthesized by first hydrogenating distilled technical cashew nut shell liquid (CNSL) with a catalyst as herein described to fully hydrogenate the olefinic chain and reacting said cashew nut shell liquid with halo carboxylic acid or ethyl chloroacetate to obtain corresponding unpolymerized cashew nut shell liquid alkyl phenoxy carboxylic acid/ester.

The Carboxylic acids required to produce the additive compositions of the present invention have 1 to 3 carboxyl based groups, and contain a halogen substituted hydrocarbon based aliphatic or alicyclic group that is, a group having a halogen atom attached directly to an aliphatic or alicyclic carbon atom, i.e., a carbon atom that is part of an aliphatic or alicyclic based group. The halogen atom in these carboxylic acid reagents is preferably chlorine or bromine. More preferably, the chlorine or bromine atom is bonded to a carbon alpha to at least one of the carboxyl based groups present.

Carboxyl based groups include free carboxylic acid groups as well as carboxylic anhydride groups, carboxylate salts of any of the metals, carboxylic acid ester groups of mono and polyhydric alcohols and carboxylic acid nitrogen containing groups such as carboxamide and ammonium carboxylate groups of the amino compounds.

Among the particularly preferred carboxylic acid reagents used to produce the compositions of this invention are alpha halo carboxylic acid reagents having 2 to 20 carbon atoms and being aliphatic or alicyclic based. Examples of carboxylic acid reagents are chloroacetic acid, ethyl chloroacetate, chloro succinic anhydride, chloro glutaric acid, sodium chloro acetate, methyl chloro stearate. Other appropriate halo carboxylic acid reagents within the scope defined above will readily occur to those skilled in the art.

The present invention further includes a lubricant composition comprising a major proportion of a material selected from the group consisting of an oil of lubricating viscosity and a grease and remainder an additive comprising cashew nut shell liquid alkyl phenoxy carboxylic acid/ester The additive is present in an amount ranging from about 0.01 to about 5 wt %, preferably 0.03 to 3 wt %.

The oil of lubricating viscosity is selected from the group consisting of a mineral oil, a synthetic oil, and mixtures thereof.

The said synthetic oils includes polypropylene glycol, trimethylol propane esters, neopentyl and pentaerythritol esters, polyethylene glycol, di(2-ethylhexyl) adipate, fluorocarbons, siloxanes, phenoxy phenyl ethers and polyalphaolefins.

The lubricant composition may include other additives such as polyalkyl succinimide and polyalkenyl ester dispersants, metallic (calcium or magnesium) sulfonates or phenates, metallic phosphorodithioates and polymeric viscosity index improvers, etc.

The said material is a grease selected from the group consisting of a lithium grease, a calcium grease, a sodium grease, a clay, and a titanium grease.

This invention is more particularly directed to lubricant compositions containing minor additive concentrations of alkyl phenoxy carboxylic acid derivatives, derived from hydrogenated distilled cashew nut shell liquid, and a major amount of oil of proper lubricating viscosity, which exhibit excellent rust inhibiting properties. Concentrations as little as 0.03% in fully formulated synthetic and mineral oil based formulations control the rusting tendency due to other additives.

Generally speaking, the process of manufacturing the additives in accordance with this invention may be carried out as follows:

Specifically, cashew nut shell liquid is distilled at reduced pressure to yield a mixture of biodegradable olefinic phenols. The components of CNSL contain a phenolic hydroxyl group and an $C_{15}H_{31-n}$ unsaturated side chain, where n=0,2,4 or 6. Such a mixture is used as such or converted to their saturated $C_{15}$ phenol derivatives by catalytic reduction in the presence of a palladium or platinum or nickel hydrogenation catalyst. The alkyl phenol is treated with halo carboxylic acid derivative in alkaline media in the presence of a solvent. After the completion of the reaction, the solvent is removed and product extracted with another organic solvent to yield the desired CNSL phenoxy carboxylic acid derivatives.

The lubricants contemplated for use herein include both mineral and synthetic hydrocarbon oils of lubricating viscosity, mixtures of mineral and synthetic oils and greases prepared therefrom.

The following examples illustrate the invention, but without intending to imply any limitation thereon.

EXAMPLE 1

Synthesis of CNSL phenoxy acetic acid 300 g of technical cashew nut shell liquid and 500 ml of xylene was charged to a 2 liter reactor equipped with agitator and condenser. The contents were warmed to 40 degree C. Subsequently 168 g of potassium hydroxide was added to the reactor and stirred for 40 minutes. Later, 94 g of chloro acetic acid was added slowly in 30 minutes. After the completion of addition of reactants, the reaction mixture was refluxed for 6 hours. On completion of the reaction, the solvent was removed and contents taken in water and acidified with dilute sulfuric acid. The mixture was extracted with hexane to yield semi solid CNSL phenoxy acetic acid.

EXAMPLE 2

Partial Hydrogenation of Distilled Technical Cashew Nut Shell Liquid (CNSL)

Distilled technical CNSL was charged to a Parr Reactor with about 1% of Nickel hydrogenation catalyst (containing 25% Nickel) or about 0.2% of Palladium on carbon (containing 10% Pd) or about 0.2% of Platinum on alumina. The reactor was charged with hydrogen at 200 Psi and at 130° C. for about 5 hours. The reaction was monitored by NMR & GC to check the reduction of olefinic chain, while controlling the conditions so as not to reduce the phenolic ring. On completion of the reaction, the catalyst was filtered out and saturated alkyl phenol was isolated.

EXAMPLE 3

Synthesis of hydrogenated CNSL phenoxy acetic acid 304 g of alkyl phenol derived by partial hydrogenation of distilled cashew nut shell liquid and 600 ml of xylene was charged to a 2 liter reactor equipped with agitator and condenser. The contents were warmed to 40 degree C. Subsequently 168 g of potassium hydroxide was added to the reactor and stirred for 40 minutes. Later, 94 g of chloro acetic acid was added slowly in 30 minutes. After the completion of addition of reactants, the reaction mixture was refluxed for 6 hours. On completion of the reaction, the solvent was removed and contents taken in water and acidified with dilute sulfuric acid. The product got separated from the aqueous mixture, which was filtered and recrystallised from methanol, having melting point 104° C.

EXAMPLE 4

Synthesis of hydrogenated CNSL phenoxy acetic acid 304 g of alkyl phenol derived by partial hydrogenation of distilled cashew nut shell liquid and 650 ml of toluene was charged to a 2 liter reactor equipped with agitator and condenser. The contents were warmed to 40 degree C. Subsequently 112 g of potassium hydroxide was added to the reactor and stirred for 40 minutes. Later, 85 g of chloro acetic anhydride was added slowly in 30 minutes. After the completion of addition of reactants, the reaction mixture was refluxed for 6 hours. On completion of the reaction, the solvent was removed and contents taken in water and acidified with dilute sulfuric acid. The product got separated from the aqueous mixture, which was filtered and recrystallised from methanol.

EXAMPLE 5

Synthesis of hydrogenated CNSL phenoxy acetic acid 152 g of alkyl phenol derived by partial hydrogenation of distilled cashew nut shell liquid and 400 ml of methanol was charged to a 1 liter reactor equipped with agitator and condenser. Subsequently 75 g of potassium carbonate was added to the reactor and stirred for 40 minutes. Later, 58 g of sodium chloro acetate was added slowly in 30 minutes. After the completion of addition of reactants, the reaction mixture was refluxed for 6 hours. On completion of the reaction, the solvent was removed and contents taken in water and acidified with dilute sulfuric acid. The product got separated from the aqueous mixture, which was filtered and recrystallised from methanol.

EXAMPLE 6

Synthesis of hydrogenated CNSL phenoxy acetate 304 g of alkyl phenol derived by partial hydrogenation of distilled cashew nut shell liquid and 500 ml of toluene was charged to a 2 liter reactor equipped with agitator and condenser. The contents were warmed to 40 degree C. Subsequently 120 g of sodium hydroxide was added to the reactor and stirred for 40 minutes. Later, 122 g of ethyl chloro acetate was added slowly in 30 minutes. After the completion of addition of reactants, the reaction mixture was refluxed for 6 hours. On completion of the reaction, the solvent was removed and contents taken in water and acidified with dilute sulfuric acid. The product was extracted with hexane.

EXAMPLE 7

Synthesis of hydrogenated CNSL phenoxy acetate 304 g of alkyl phenol derived by partial hydrogenation of distilled cashew nut shell liquid and 800 ml of ethanol was charged to a 2 liter reactor equipped with agitator and condenser. The contents were warmed to 40 degree C. Subsequently 105 g of sodium carbonate was added to the reactor and stirred for 40 minutes. Later, 167 g of ethyl bromo acetate was added slowly in 30 minutes. After the completion of addition of reactants, the reaction mixture was refluxed for 6 hours. On completion of the reaction, the solvent was removed and contents taken in water and acidified with dilute hydrochloric acid. The product was extracted with heptane.

Performance evaluation of products

The synthesised CNSL phenoxy carboxylic acid and ester derivatives were evaluated in a solvent refined, highly paraffinic, 150 neutral grade, mineral base oil having a kinematic viscosity of 28.8 at 40° C. and 5.0 cSt at 100° C. This base oil was blended with 3.5% of Sulphurised isobutylene based EP additive as reference set. In addition, a GL-5 lubricant formulation was blended as reference, having all the essential components, like antiwear additive, extreme pressure additive, corrosion inhibitor, anti foam additive, antioxidants etc., but without any rust inhibitor. The results of these tests are given in Table 1.

TABLE 1

Rust Inhibiting Performance of Additives of Present Invention

| S. No. | Additive | Additive Dosage | Lubricant Formulation | Rust Rating (ASTM D-665A) | Rust Rating (ASTM D-665A) | Rust Rating (L-33) |
|---|---|---|---|---|---|---|
| 1. | — | — | Base Oil | Fail | Fail | |
| 2. | Example 1 | 0.1% | Base Oil having 3.5% EP Additive | Pass | Pass | |
| 3. | Example 1 | 0.05% | Base Oil having 3.5% EP Additive | Pass | Pass | |
| 4. | Example 3 | 0.025% | Base Oil having 3.5% EP Additive | Pass | Pass | |
| 5. | Example 3 | 0.025% | Base Oil having 3.5% EP Additive | Pass | Pass | |
| 6. | Example 4 | 0.025% | Base Oil having 3.5% EP Additive | Pass | Pass | |
| 7. | Example 5 | 0.025% | Base Oil having 3.5% EP Additive | Pass | Pass | |
| 8. | Example 6 | 0.025% | Base Oil having 3.5% EP Additive | Pass | Pass | |
| 9. | Example 7 | 0.025% | Base Oil having 3.5% EP Additive | Pass | Pass | |

TABLE 1-continued

Rust Inhibiting Performance of Additives of Present Invention

| S. No. | Additive | Additive Dosage | Lubricant Formulation | Rust Rating (ASTM D-665A) | Rust Rating (ASTM D-665A) | Rust Rating (L-33) |
|---|---|---|---|---|---|---|
| 10. | Commercial RI, Irgacor NPA (CIBA) | 0.025% | Base Oil having 3.5% EP Additive | Pass | Pass | |
| 11. | — | — | Gear Oil (GL-5) | Fail | Fail | 4.5 |
| 12. | Example 1 | 0.25% | Gear Oil (GL-5) | Pass | Pass | 10 |
| 13. | Example 3 | 0.25% | Gear Oil (GL-5) | Pass | Pass | 10 |
| 14. | Example 4 | 0.25% | Gear Oil (GL-5) | Pass | Pass | 10 |
| 15. | Example 5 | 0.30% | Gear Oil (GL-5) | Pass | Pass | 10 |
| 16. | Example 6 | 0.30% | Gear Oil (GL-5) | Pass | Pass | 10 |
| 17. | Example 7 | 0.30% | Gear Oil (GL-5) | Pass | Pass | 10 |
| 18. | Commercial RI, Irgacor NPA (CIBA) | 0.30% | Gear Oil (GL-5) | Pass | Pass | 10 |

The above data clearly demonstrates that additive amounts of the phenoxy carboxylic acid derivatives, derived from technical CNSL or partially hydrogenated CNSL, in premium quality automotive and industrial lubricants significantly control the rust formation. The unique additives described in this patent application are useful at low concentrations, are non-metallic and do not contain any potentially corrosive sulfur. These salts can be readily prepared in a one pot process. Furthermore, development and use of these rust inhibiting lubricant/fuel additives, derived from CNSL, a renewable and biodegradable product from vegetable sources and often available at very low price, would amount to substantial overall reduction in the cost of quality, energy efficient lubricant/fuel formulations.

We claim:

1. A process for the preparation of phenoxy carboxylic acid derivatives for use as an additive in a lubricant composition comprising:

reacting technical cashew nut shell liquid or partially saturated cashew nut shell liquid with halogeno carboxylic acid reagent having from 1 to 3 carboxyl groups, to obtain corresponding unpolymerized cashew nut shell liquid carboxylic acid derivative, the reaction being carried out at a temperature ranging from 20 to 140° C.

2. A process as claimed in claim 1 wherein said partially saturated cashew nut shell liquid is obtained by partially hydrogenating technical cashew nut shell liquid with a catalyst to fully hydrogenate the olefinic chain.

3. The process as claimed in claim 2 wherein said catalyst is palladium, platinum or nickel.

4. The process as claimed in claim 1, wherein the at least one halogeno carboxylic acid derivative is derived from fluoro, chloro, bromo or iodo carboxylic acid derivative.

5. The process as claimed in claim 1, wherein halogeno carboxylic acid reagent is chloro acetic acid or corresponding metal chloroacetate.

6. The process as claimed in claim 1, wherein halogeno carboxylic acid reagent is ethyl chloro acetate or ethyl bromo acetate.

7. The process as claimed in claim 1, wherein the reaction is carried out in the presence of a solvent.

8. The process as claimed in claim 1, wherein the reaction is carried out in an alkaline media.

9. The process as claimed in claim 8, wherein the alkaline media is derived from an alkali metal hydroxide.

10. The process as claimed in claim 8, wherein the alkaline media is derived from an alkali metal carbonate or bicarbonate.

11. A lubricant composition comprising:

a major proportion of a material selected from the group consisting of an oil of lubricating viscosity and a grease; and remainder an additive comprising cashew nut shell liquid phenoxy carboxylic acid derivative, which is a condensation product of technical or partially hydrogenated cashew nut shell liquid with at least one halo carboxylic acid reagent.

12. The lubricant composition as claimed in claim 11, wherein the additive is present in an amount ranging from about 0.01 to about 5 wt %.

13. The lubricant composition as claimed in claim 12, wherein the oil of lubricating viscosity is selected from the group consisting of a mineral oil, a synthetic oil, and mixtures thereof.

14. The lubricant composition as claimed in claim 13 wherein said synthetic oil is selected from the group consisting of polypropylene glycol, trimethylol propane esters, neopentyl and pentaerythritol esters, polyethylene glycol, di(2-ethylhexyl) adipate, fluorocarbons, siloxanes, phenoxy phenyl ethers and polyalphaolefins.

15. The lubricant composition as claimed in claim 12 wherein said composition includes other additives selected from the group consisting of polyalkyl succinimide and polyalkenyl ester dispersants, metallic (calcium or magnesium) sulfonates or phenates, metallic phosphorodithioates and polymeric viscosity index improvers.

16. The lubricant composition as claimed in claim 12, wherein the material is a grease selected from the group consisting of a lithium grease, a calcium grease, a sodium grease, a clay, and a titanium grease.

17. The lubricant composition as claimed in claim 12 wherein the additive is present in an amount ranging from about 0.03 to about 3 wt %.

* * * * *